US005630401A

United States Patent [19]

Binversie et al.

[11] Patent Number: 5,630,401

[45] Date of Patent: May 20, 1997

[54] COMBINED FUEL INJECTION PUMP AND NOZZLE

[75] Inventors: Gregory J. Binversie, Grayslake; David J. Hall, Zion, both of Ill.; Richard T. Tunkieicz; Paul W. Breckenfeld, both of Kenosha, Wis.

[73] Assignee: Outboard Marine Corporation, Waukegan, Ill.

[21] Appl. No.: 276,545

[22] Filed: Jul. 18, 1994

[51] Int. Cl.[6] ..... F02M 37/04; F04B 17/04

[52] U.S. Cl. ..... 123/495; 123/509; 417/417

[58] Field of Search ..... 417/417; 123/495, 123/499

[56] References Cited

U.S. PATENT DOCUMENTS

| | | | |
|---|---|---|---|
| 2,691,739 | 10/1954 | McHenry et al. . | |
| 3,236,219 | 2/1966 | Bilisco | 123/495 |
| 3,267,866 | 8/1966 | Unger . | |
| 3,400,663 | 9/1968 | Wertheimer . | |
| 3,556,684 | 1/1971 | Rouquette . | |
| 4,116,591 | 9/1978 | Mardell . | |
| 4,169,696 | 10/1979 | Brown . | |
| 4,295,453 | 10/1981 | Seilly et al. | 417/417 |
| 4,300,873 | 11/1981 | Mowbray et al. | 417/416 |
| 4,312,316 | 1/1982 | Seilly et al. | 417/417 |
| 4,389,169 | 6/1983 | De Dionigi . | |
| 4,610,080 | 9/1986 | Hensley . | |
| 4,643,653 | 2/1987 | Masaka et al. . | |
| 4,743,179 | 5/1988 | Waas et al. . | |
| 4,747,384 | 5/1988 | Hafner et al. . | |
| 4,749,343 | 6/1988 | Brown . | |
| 4,787,823 | 11/1988 | Hultman | 417/417 |
| 4,804,314 | 2/1989 | Cusack | 417/417 |
| 4,844,339 | 7/1989 | Sayer et al. . | |
| 4,934,907 | 6/1990 | Kroner . | |
| 4,967,959 | 11/1990 | Weiczorek . | |
| 4,978,074 | 12/1990 | Weinand . | |
| 5,016,819 | 5/1991 | Wood . | |
| 5,172,669 | 12/1992 | Nakamura . | |
| 5,176,117 | 1/1993 | Motose et al. . | |
| 5,192,048 | 3/1993 | Wakeman . | |
| 5,203,538 | 4/1993 | Matsunaga et al. . | |
| 5,207,387 | 5/1993 | Bergstrom . | |
| 5,355,856 | 10/1994 | Paul et al. | 123/446 |
| 5,357,933 | 10/1994 | Kasahara et al. | 123/506 |
| 5,357,944 | 10/1994 | Rathmayr | 123/509 |

FOREIGN PATENT DOCUMENTS

| | | |
|---|---|---|
| 41 07 622 A 1 | 10/1992 | Germany . |
| 4-183958 | 6/1992 | Japan . |
| 1574132 | 9/1980 | United Kingdom . |
| 2083565 | 3/1982 | United Kingdom . |

*Primary Examiner*—Thomas N. Moulis
*Attorney, Agent, or Firm*—Jones, Day, Reavis & Pogue

[57] ABSTRACT

An internal combustion engine including an engine block including a cylinder head defining a combustion chamber and having therein an opening communicating with the combustion chamber, and a combined fuel injection pump and nozzle including a housing fixed to the cylinder head and defining a high reluctance gap and a low pressure fuel chamber having an axis, a tubular member extending in the housing into the low pressure fuel chamber in coaxial relation to the axis, having therein an axial bore communicating with the low pressure fuel chamber, and at least partially defining a high pressure fuel chamber, and a nozzle assembly fixed to the housing, extending into the opening, communicating with the combustion chamber and with the axial bore, and including a valve member moveable to an open position in response to a fuel pressure in the high pressure fuel chamber above a predetermined level.

25 Claims, 1 Drawing Sheet

COMBINED FUEL INJECTION PUMP AND NOZZLE

BACKGROUND OF THE INVENTION

The invention relates generally to internal combustion engines and, more particularly, to fuel injection systems for internal combustion engines. Still more particularly, the invention relates to solenoid operated axial flow fuel pumps and to pressure surge fuel injection mechanisms or valves. Attention is directed to the following U.S. patents:

| | | |
|---|---|---|
| 2,691,739 | McHenry, et al. | October 12, 1954 |
| 3,556,684 | Rouquette | January 19, 1971 |
| 4,169,696 | Brown | October 2, 1979 |
| 4,610,080 | Hensley | September 9, 1986 |
| 4,747,384 | Hafner, et al. | May 31, 1988 |
| 4,967,959 | Wiezorek | November 6, 1990 |
| 5,016,819 | Wood | May 21, 1991 |
| 5,203,538 | Matsunaga, et al. | April 20, 1993 |
| 5,207,387 | Bergstrom | May 4, 1993 |

Attention is also directed to German Publication DE 41 07 622 Al of Sep. 10, 1992.

SUMMARY OF THE INVENTION

The invention provides an internal combustion engine including an engine block including a member defining a combustion chamber and having therein an opening communicating with the combustion chamber, and a combined fuel injection pump and nozzle including a housing fixed to the engine block member and defining a high reluctance gap and a low pressure fuel chamber having an axis, a tubular member extending in the housing into the low pressure fuel chamber in coaxial relation to the axis, having therein an axial bore communicating with the low pressure fuel chamber, and at least partially defining a high pressure fuel chamber, and a nozzle assembly fixed to the housing, extending into the opening, communicating with the combustion chamber and with the axial bore, and including a valve member moveable to an open position in response to a fuel pressure in the high pressure fuel chamber above a predetermined level.

The invention also provides a combined fuel injection pump and nozzle adapted to be mounted on an engine block and comprising a housing member defining a high reluctance gap and a low pressure fuel chamber having an axis, a tubular member extending from the housing member into the low pressure fuel chamber in coaxial relation to the axis, having therein an axial bore communicating with the low pressure fuel chamber, and at least partially defining a high pressure fuel chamber, and a nozzle assembly fixed to the housing member, communicating with the axial bore, and including a valve member moveable to an open position in response to a fuel pressure in the high pressure fuel chamber above a predetermined level.

The invention also provides a combined fuel injection pump and nozzle comprising a first housing member, a second housing member fixed to the first housing member and defining therebetween a high reluctance gap and a low pressure fuel chamber having an axis, a tubular member extending from one of the housing members into the low pressure fuel chamber in coaxial relation to the axis, having therein an axial bore communicating with the low pressure fuel chamber, and at least partially defining a high pressure fuel chamber, and a nozzle assembly fixed to the one housing member, adapted to be mounted on a cylinder head, communicating with the axial bore, and including a valve member moveable to an open position in response to a fuel pressure in the high pressure fuel chamber above a predetermined level.

The invention also provides a fuel injection pump and nozzle comprising a first housing member having an axis and including an end portion extending transversely to the axis, and a cylindrical bobbin supporting portion extending from the end portion in concentric relation to the axis, and a second housing member fixed to the first housing member and including an end portion extending transversely to the axis, a cylindrical bobbin supporting portion extending from the end portion of the second housing member in concentric relation to the axis and in concentric alignment with and in spaced relation to the bobbin supporting portion of the first housing member to define therebetween a high reluctance gap, and a cylindrical housing portion extending from the end portion of the second housing member in co-axial relation to the axis and in the direction opposite to the second bobbin portion of the second housing member and defining a bore, a tubular member extending in co-axial relation to the axis, having therein an axial bore, and including an inner part rigidly fixed in the end portion of the second housing member, and a projecting part having an outer surface extending from the end portion of the second housing member in inwardly spaced relation to the bobbin supporting portion of the second end member, and defining, with the bobbin supporting portions, a fuel chamber adapted to contain a fuel pumping assembly and communicating with the axial bore in the tubular member, and a valve assembly including a valve housing fixed in the bore of the cylindrical housing portion of the second housing member and including an axial bore communicating with the axial bore of the tubular member and having an end portion defining a valve seat, and a valve member moveable in the axial bore in the valve housing between a closed position engaged with the valve seat and an open position spaced from the valve seat.

The invention also provides a fuel injection pump and nozzle assembly comprising a fuel injection pump having an axis and comprising a first one-piece housing member including an end portion extending transversely to the axis, a cylindrical bobbin supporting portion extending from the end portion in concentric relation to the axis, and a cylindrical housing portion having a threaded open end and extending from the end portion in concentric to relation the axis and in radially outwardly spaced relation from the bobbin supporting portion to partially define there between a bobbin compartment, a second one-piece housing member including an end portion extending transversely to the axis, a radially outer cylindrical housing portion extending from the end portion of the second housing member in concentric relation to the axis and having a threaded open end threadedly received in the threaded open end of the housing portion of the first housing member, and a cylindrical bobbin supporting portion extending from the end portion of the second housing member in concentric relation to the axis, and in concentric alignment with and in spaced relation to the bobbin supporting portion of the first housing member to define therebetween a high reluctance gap, and in radially inwardly spaced reaction from the housing portion of the second housing member to partially define therebetween the bobbin compartment, a tubular member extending in co-axial relation to the axis, having therein an axial bore, and including an inner part rigidly fixed in the end portion of the second housing member, and a projecting part having an outer surface in inwardly spaced relation to the bobbin supporting portion of the second housing member, and extending into partially axially overlapping relation to the bobbin supporting portion of the first housing member, and defining with the bobbin supporting portions a low pressure fuel chamber, and one-way valve means located in the second housing member, communicating with the axial bore, and being selectively operable to permit flow from the axial bore for delivery to a fuel injecting nozzle and to prevent flow to the axial bore, an armature and valve assembly which has an outer surface radially separated from the bobbin supporting portions to further define therebetween the low pressure fuel chamber, which is axially movably supported on the outer surface of the projecting part of the tubular member, and which is operative in response to axial movement thereof relative to the tubular member to increase the pressure of the fuel in the axial bore in the tubular member to a relatively high pressure, and a bobbin contained in the bobbin compartment and including a cylindrical portion located adjacent the bobbin supporting portions and having opposite first and second ends, and a central flange extending from the cylindrical portion and including first and second transverse surfaces, a first o-ring sealingly engaged between the bobbin supporting portion of the first housing member and the first transverse surface of the bobbin, and a second o-ring sealingly engaged between the bobbin supporting surface of the second housing member and the second transverse surface of the bobbin.

The invention also provides a combined fuel injection pump and nozzle assembly comprising a first one-piece housing member fabricated of ferrous material, having an axis, and comprising an end portion extending transversely to the axis, a cylindrical bobbin supporting portion extending from the end portion in concentric relation to the axis, and a cylindrical housing portion extending from the end portion in concentric relation to the axis, and in radially outwardly spaced relation from the bobbin supporting portion to partially define therebetween a bobbin compartment, and having a threaded open end, a second one-piece housing member fabricated of ferrous material and including an end portion extending transversely to the axis, a cylindrical housing portion extending in concentric relation to the axis and having a threaded open end threadedly received in the open end of the housing portion of the first housing member, a cylindrical bobbin supporting portion extending from the end portion of the second housing member in concentric relation to the axis and in concentric alignment with and in spaced relation to the bobbin supporting portion of the second housing member to define therebetween a high reluctance gap, and in radially inwardly spaced reaction from the housing portion of the second housing member to partially define therebetween the bobbin compartment, and a projecting portion extending from the end portion of the second housing member in the direction opposite from the bobbin supporting portion of the second housing member and having an axial bore concentric with the axis, a tubular member fabricated of ferrous material, extending in coaxial relation to the axis, having therein an axial bore, and including an inner part rigidly fixed in the end portion of the second housing member, and a projecting part having an outer surface in inwardly spaced relation to the bobbin portion of the second housing member, and extending from the end portion of the second housing member into partially axially overlapping relation to the bobbin supporting portion of the first housing member, and defining with the bobbin supporting portions a low pressure fuel chamber, a nozzle assembly fixed to the projecting portion and being adapted for direct communication with a combustion chamber, a one-way check valve located in the second housing member, communicating between the axial bore of the tubular member and the nozzle assembly, and being selectively operable to permit flow from the axial bore of the tubular member to the nozzle assembly and to prevent flow from the nozzle assembly to the axial bore of the tubular member, an armature and valve assembly which has an outer surface radially separated from the bobbin supporting portions and further defining therebetween the low pressure fuel chamber, which is axially movably supported on the projecting part of the tubular member, and which includes a bushing fabricated of non-ferrous material and including an outer surface, an end facing the end portion of the second housing member, and an interior bore in axially moveable sliding engagement on the outer surface of the projecting part of the tubular member, a sub-assembly fabricated of ferrous material, rigidly fixed on the outer surface of the bushing, and including an inner bore communicating with the axial bore of the tubular member to afford fuel flow therebetween and including a valve seat spaced from the end of the bushing, a valve member movable in and relative to the inner bore between spaced positions respectively preventing and permitting fuel flow through the inner bore and having a head located between the valve seat and the end of the bushing and including a valve surface in facing relation to the valve seat, and passage means affording fuel flow from the low pressure fuel chamber to the inner bore upstream of the valve seat, a bobbin fabricated of electrically insulating material, contained in the bobbin compartment and including a cylindrical portion located adjacent the bobbin supporting portions and having opposite first and second ends, and a central flange portion extending from the cylindrical portion into the gap and including first and second transverse surfaces, a first o-ring sealingly engaged between the bobbin supporting portion of the first housing member and the first transverse surface, and a second o-ring sealingly engaged between the bobbin supporting portion of the second housing member and the second transverse surface.

The invention also provides a one-way valve comprising a valve body having therein a valve seat, a valve member located in the valve body and including a valve seat engaging surface, one of the valve seat and the valve seat engaging surface being fabricated of soft rubber-like material, and means operative between the valve body and the valve member for biasing the valve member for movement so as to engage the valve seat.

The invention also provides a one-way valve comprising a valve body having therein a bore, and a wall extending radially outwardly from the bore, a member located in the valve body, a valve member of soft rubber-like material fixed on the member and projecting therefrom for engagement with the radially extending surface to sealingly close the bore, and means operative between the valve body and the member for biasing the member for movement thereof so as to engage the valve member with the radially extending surface.

The invention also provides a one-way valve comprising a valve body having therein a bore including a co-axial counter bore having a cylindrical wall surface with a diameter, and a radial wall extending between the bore and the counter bore, a member located in the counter bore and having a first end adjacent the bore, a second end remote from the bore, a cylindrical outer wall surface with a diameter less then the diameter of the counter bore wall surface, a first recess in the first end, and a second recess in the second end, a valve member of soft rubber-like material fixed in the first recess and projecting therefrom for engagement with the radially extending surface to sealingly close the bore, a helical spring extending into the second recess and having a first end bearing against the member and a second end, and means on the valve body engageable with the second spring end for fixing the second spring end against movement relative to the valve body.

Other features and advantages of the invention will become apparent to those skilled in the art upon review of the following detailed description, claims, and drawings.

Figure 1:
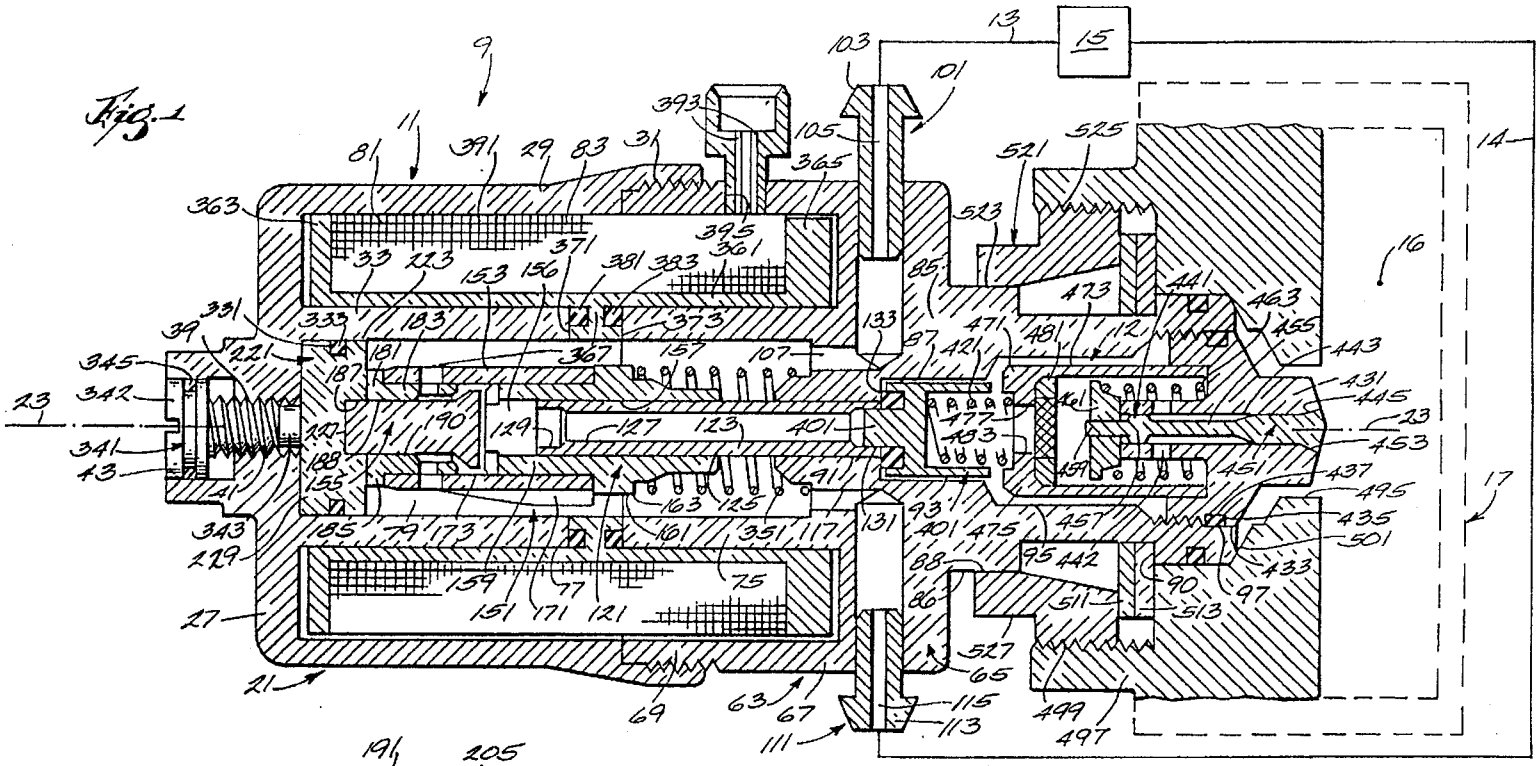
FIG. 1 is a fragmentary sectional view of a combined fuel injection pump and nozzle assembly embodying various of the features of the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF PREFERRED EMBODIMENT

Illustrated in the drawings is a combined fuel injection pump and nozzle assembly 9 including a pressure surge fuel injection mechanism or valve or pump 11 and a nozzle or valve assembly 12. The combined fuel injection pump and nozzle assembly 9 is adapted to be connected in communication through supply and return conduits 13 and 14 with a source of low pressure fuel, such as a low pressure fuel pump 15, is solenoid operated, operates to raise the pressure in the fuel to a relatively high pressure, and to deliver the high pressure fuel through the nozzle or valve assembly 12 to a combustion chamber 16 (shown schematically) of an internal combustion engine 17 (shown schematically) in response to the presence at the nozzle or valve assembly 12 of the high pressure fuel.

The combined fuel injection pump and nozzle assembly 9 includes a first a one-piece housing member 21 which is fabricated of ferrous material, such as steel, which has an axis 23, and which comprises an end portion 27 extending transversely to the axis 23, an outer cylindrical housing portion 29 concentric with the axis 23 and including an internally threaded outer open end 31 spaced from the end portion 27, and a cylindrical bobbin supporting portion 33 extending from the end portion 27 in concentric relation to the axis 23, and in inwardly radially spaced relation from the outer cylindrical portion 29.

The first housing member 21 also includes a bore 39 which extends axially through the end portion 27 in concentric relation to the axis 23 and which includes a threaded right end portion 41 and an enlarged counterbore 43 extending to the left and opening into the atmosphere.

The combined fuel injection pump and nozzle assembly 9 also includes a second one-piece housing member 63 which is fabricated of ferrous material, such as steel, and which includes an end portion 65 extending transversely to the axis 23, and an outer cylindrical portion 67 extending concentrically to the axis 23 and including an open externally threaded outer end 69 threadedly engaged with the threaded open end 31 of the outer cylindrical housing portion 29 of the first housing member 21. The outer end of the outer cylindrical portion 67 beyond the threads, i.e., to the left thereof, includes an external cylindrical pilot surface engageable with a mating internal cylindrical surface on the housing portion 29 to insure concentricity between the housing members 21 and 63.

The second housing member 63 also includes a bobbin supporting portion 75 extending from the end portion 65 in concentric relation to the axis 23, in inwardly spaced relation from the outer cylindrical portion 67 and in concentric alignment with, and in spaced relation to, the cylindrical bobbin supporting portion 33 of the first housing member 21 so as thereby to define a high reluctance gap 77 located centrally between the bobbin supporting portions 33 and 75 of the first and second housing members 21 and 63 and having an axial length sufficient to provide a ring or zone of flux obstruction, i.e., a high reluctance ring or zone through which lines of magnetic flux do not readily travel.

The end portions 27 and 65 and the bobbin supporting portions 33 and 75 define therebetween a low pressure fuel pumping chamber 79 which, as will be come apparent, forms part of a low pressure fuel circuit extending to and from the low pressure pump 15.

In addition, the end portions 27 and 65, the bobbin supporting portions 33 and 75, and the outer cylindrical housing portions 29 and 67 define therebetween a compartment 81 adapted to house or contain a bobbin 83.

The second housing member 63 also includes a cylindrical projecting portion 85 which has an outer surface 86 and which extends concentrically with the axis 23 and from the end portion 65 in the opposite direction from the cylindrical bobbin supporting portion 75. The outer surface 86 includes a cylindrical surface portion 88 and a radially outwardly extending shoulder or flange 90. In addition, the end portion 65 and the projecting portion 85 include an axial bore 87 which includes a first portion 91 located in the end portion 65 and communicates with the fuel pumping chamber 79, together with successively enlarged first, second, and third counterbores 93, 95, and 97. The third counterbore 97 is open to the right, as shown in FIG. 1, and, at the right end thereof, is internally threaded.

The second housing member 63 also includes a fuel inlet 101 including a nipple 103 communicating with a radially extending bore 105 which is located in the end portion 65 and which, in turn, communicates with an axially extending bore 107 communicating with the fuel pumping chamber 79.

The second housing member 63 also includes a fuel outlet 111 including a nipple 113 communicating with a radially extending bore 115 which is located in the end portion 63 in diametrically opposite relation to the fuel inlet bore 107, and which, in turn, communicates with an axially extending bore 117 communicating with the fuel pumping chamber 79. The fuel inlet nipple 103 is connected to the supply duct or conduit 13 communicating with the low pressure pump 15 and the fuel outlet nipple 113 is connected to the return duct or conduit 14 which communicates with the low pressure supply pump 15 and serves to return excess fuel to the low pressure supply pump 15.

The combined fuel injection pump and nozzle assembly 9 also includes a tubular member or portion 121 which is fabricated from ferrous material, such as steel, which is pressed fitted or otherwise suitably fixed in the first portion 91 of the axial bore 87 in the end portion 65 of the second housing member 63 and includes a projecting portion 123 which extends in co-axial relation to the axis 23 and into the fuel pumping chamber 79 and which includes an outer surface 125. The tubular member 121 also includes an axial bore 127 having a left counterbored supply end 129 communicating with the fuel pumping chamber 79 and a right counterbored delivery end 131 terminating in approximately flush relation to a shoulder 133 in the axial bore 87 between the first portion 91 and the first counterbore 93.

Located in the low pressure fuel pumping chamber 79 in slidable engagement on the outer surface 125 of the projecting portion 123 of the tubular member 121 is an armature and valve assembly 151 comprising a bushing 153 which is fabricated of non-ferrous material, i.e., non-flux conducting material, such as bronze, and an armature and valve sub-assembly 155 which is fabricated of ferrous material, such as steel, which is rigidly fixed on the bushing 153 for common movement therewith within the low pressure fuel chamber 79 and along the tubular member 121 and between a spring biased position which is shown in full lines in FIG. 1, wherein the low pressure fuel chamber 79 communicates with a high pressure fuel chamber 156 which is located within the low pressure fuel chamber 79 and which is described hereinafter in greater detail, and a second electromagnetically actuated position located to the right of the location of the armature and valve assembly 151 shown in FIG. 1, and wherein the low pressure fuel chamber 79 is sealed from the high pressure fuel chamber 156 and the fuel in the axial bore 127 of the tubular member 121 is placed under relatively high pressure.

More particularly, the bushing 153 comprises an elongated generally cylindrical member having an internal bore 157 which slidingly engages the outer surface 125 of the projecting portion 123 of the tubular member 121. The bushing 153 also includes an outer surface including a first or left cylindrical surface portion 159, a second or central cylindrical surface portion 161 to the right of the surface portion 159 and having a diameter greater than the diameter of the first cylindrical surface portion 159, and a radial surface or shoulder 163 extending inwardly from the left end of the central cylindrical surface portion 161 to provide a seat for a biasing spring still to be described. As can be seen in FIG. 1, the radially outer central surface portion 161 of the bushing 153 is substantially spaced from the inner surface of the bobbin supporting portions 33 and 75. It is also noted that the axial engagement of the bushing 153 on the tubular member 121 is relatively lengthy and that such length of engagement is effective to seal the sliding engagement between the bushing 153 and the tubular member 121 from fuel leakage even when the fuel in the high pressure fuel chamber 156 is under relatively high pressure.

The armature and valve sub-assembly 155 includes an armature member 171 which is fabricated of ferrous material, which is generally cylindrical in shape, which has a central axial bore 173, and which, at one end of the axial bore 173, is rigidly fixed, as by brazing or otherwise, on the cylinder surface portion 159 of the bushing 153.

The armature and valve sub-assembly 155 also includes a valve seat member 181 which is fabricated of ferrous material, which is also generally cylindrical in shape, and which includes a cylindrical part 183 which is rigidly fixed, as by press fitting or otherwise, into the left end of the axial bore 173 of the armature member 171, and which terminates in axially spaced relation to the left end of the bushing 153 which, in turn, is variably axially spaced from the supply end 129 of the tubular member 121. In addition the valve seat member 181 includes a flange part 185 which engages the left end of the armature member 171.

It is noted that the high pressure fuel chamber 156 is defined, in part, within the axial bore 173 of the armature member 171 and between the right end of the valve seat member 181 and the left end of the bushing 153 and within the axial bore 173 of the bushing 153 between the left end thereof and the delivery end 131 of the tubular member 121. It is further noted that this last mentioned space is variable in volume in response to movement of the bushing 153 relative to the tubular member 121. As already noted, the high pressure fuel chamber 156 also includes the axial bore 127 of the tubular member 121.

Formed centrally within the valve seat member 181 is another concentrically located axial bore 187 having a left end portion 188 and a right end portion 190 which communicates with the high pressure fuel chamber 156, which has a diameter larger than the diameter of the left end portion 188, and which is axially spaced from the left end of the bushing 153.

Figure 2:
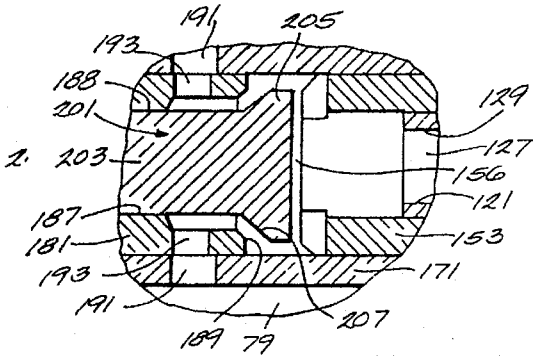
FIG. 2 is a fragmentary enlarged view of a portion of the combined assembly shown in FIG. 1 and with the parts shown in an open position.

The end part of the right end portion 190 of the axial bore 187 is (see FIG. 2) chamfered to provide a conically shaped valve seat 189. The armature member 171 and the valve seat member 181 respectively diametrically opposite and aligned radial bores 191 and 193 which provide means for affording fuel flow between the low pressure fuel chamber 79 and the interior of the right end portion of the axial bore 187, and hence for affording fuel flow to the high pressure fuel chamber 156 as will be described hereinafter.

The armature and valve sub-assembly 155 also includes a valve member 201 which includes a cylindrical shank 203 slidingly engaged in the left end portion 188 of the axial bore 187 in the valve seat member 181. The valve member shank 203 extends axially outwardly from the left end portion of the axial bore 187.

The valve member 201 also includes a head 205 which extends from the shank 203, which is located in the high pressure fuel chamber 156 between the valve seat 189 and the left end of the bushing 153, and which has a conical valve surface 207 in facing relation to the valve seat 189 on the valve seat member 181.

The valve member 201 is axially movable relative to the valve seat member 181 between an open position (see FIG. 1) affording fuel flow from the radial bores 191 to the high pressure fuel chamber 156, and a position wherein the valve surface 207 engages the valve seat 189 and seals the high pressure chamber 156 from the low pressure fuel chamber 79 and wherein the shank 203 extends axially outwardly to the left of the valve seat member 181.

The outer surface of the armature and valve assembly 151 is spaced from the inner surface of the bobbin supporting portions 33 and 75 to permit free fuel flow between the supply bore 105 and the return bore 115 and to the bores 191, and to facilitate unimpeded movement of the armature and valve assembly 151 on the tubular member 121 and within the low pressure fuel chamber 79.

Means are provided to permit adjustment of the length of the fuel pumping stroke. While other constructions can be employed, in the disclosed construction, there is provided, between the end portion 27 of the first housing member 21 and the armature and valve assembly 151, a stop member or adjusting piston 221 which is fabricated of plastic material, and which has an outer circumferential surface 223 engaging the bobbin supporting portion 33 of the first housing member 21, an inner face 225 engaging the left end of the valve seat member 181 and including a central blind bore or recess 227 receiving and engaging the shank 203 of the valve member 201, and an outer face 229 adjacent the end portion 27. Located in an annual groove 331 in the outer surface 223 is a sealing member in the form of an O-ring 333 which prevents escape of fuel from the low pressure fuel pumping chamber 79.

The adjustment means also includes an adjusting screw 341 which extends in the axial bore 39 of the end portion 27 of the first housing member 21 and threadedly engages the right end portion 41 thereof. The adjusting screw 341 includes a head 342 and an end part 343 and can be adjustably extended toward and into engagement with the adjusting piston 221 to adjustably effect displacement thereof to adjust the length of the fuel pumping stroke. If desired, a seal in the form of an O-ring 345 can be provided between the head 342 of the adjusting screw 341 and the counterbore 43 in the end portion 27.

Means are provided for biasing the armature and valve assembly 151 to the left in FIG. 1 and to the solid line position shown therein. While other constructions can be employed, in the disclosed construction, such means comprises a helical spring 351 which, at one end, engages the radial surface or shoulder 163 on the bushing 153, which, at the other end, engages the end portion 65 of the second housing member 63, and which extends in surrounding relation to the tubular member 121.

Located in the radially outer bobbin compartment 81 is the bobbin 83 which is fabricated of non-flux conducting material, such as plastic, and which includes a cylindrical portion 361 located adjacent the outer surfaces of the bobbin supporting portions 33 and 75, and opposite left and right end portions 363 and 365 respectively extending adjacent the end portions 27 and 65 of the first and second housing members 21 and 63. Located centrally on the cylindrical portion 361 is an annular flange 367 which extends into the annular gap or space 77. The annular flange 367 includes oppositely facing surfaces 371 and 373 respectively including annular grooves receiving seals in the form of O-rings 381 and 383 sealingly engaged between the annular flange 367 and the adjacent ends of the bobbin supporting portions 33 and 75, thereby preventing loss of fuel through the gap 77 while retaining the reluctance character of the gap 77.

Located on the cylindrical portion 361 of the bobbin 81 and between the end portions 363 and 365 is a suitable electrical coil 391 which includes leads 393 extending through an aperture 395 in the outer cylindrical housing portion 67 of the second housing member 63 to a suitable electrical control (not shown).

Figure 3:
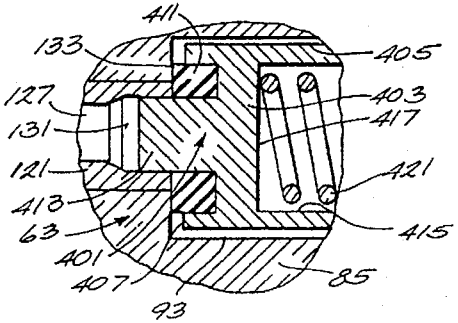
FIG. 3 is a fragmentary enlarged view of another portion of the combined assembly shown in FIG. 1 and with the parts shown in a closed position.

Means are provided for permitting flow from the high pressure fuel chamber 156, i.e., from the axial bore 127 of the tubular member 121, and for preventing return flow into the axial bore 127. While other specific constructions can be employed, in the disclosed construction, as shown in FIG. 3, a one-way check valve 401 is located in the first counter bore 93 of the projecting portion 85 of the second housing member 63 and comprises a cylindrical member 403 including an outer surface 405 which is spaced from the wall of the first counter bore 93 to afford fuel flow therebetween, which, at the left end thereof, includes an annular recess 407 housing an annular valve member or element 411, and a guide projection 413 adapted to enter into the left or delivery end 131 of the tubular member 121. At the right end thereof, cylindrical member 403 includes a cylindrical recess 415 which is of substantial axial length and which includes a radially, extending inner end surface or base 417.

Means are provided for biasing the valve member 411 into a position sealing the right or delivery end 131 of the axial bore 127 of the tubular member 121. While various arrangements can be employed, in the disclosed construction, there is provided a helical spring 421 which extends into the cylindrical recess 415, which, at one end, bears against the base 417, and which, at the other end, bears against the valve or nozzle assembly 12. The spring 421 operates to normally seal off the delivery end 131 of the axial bore 127 of the tubular member 121 in the absence of relatively high pressure within the high pressure fuel chamber 156.

The valve or nozzle assembly 12 is also disclosed in copending application Ser. No. 08/276,718 now U.S. Pat. No. 5,472,013 which is incorporated herein by reference, and includes a valve housing 431 which includes a cylindrical main portion 432 and is threadedly received into the third counterbore 97 of the projecting portion 85 of the second housing member 63. The main portion 432 includes an outer surface 433 with an annular groove 435 receiving a seal member in the form of an O-ring 437 sealingly engaged between the valve housing 431 and the third counterbore 97 of the projecting portion 85 of the second housing member 63.

The valve housing 431 also includes a cylindrical portion 441 which extends from the main portion 432 toward the end portion 65 of the second housing member 63 and which is of lesser diameter than the inner surface of the second counterbore 95 of the projecting portion 85 of the second housing member 63. Extending axially of the valve housing 431 is an axial bore 443 which, at the far right end, includes a radially outwardly extending valve seat 445. Located in the cylindrical portion 441 are one or more transverse apertures 442 permitting fuel flow from radially outwardly of the cylindrical portion 441 into the axial bore 443.

Located in the axial bore 443 is a valve member 451 which, at the right end thereof, includes a radially outwardly extending valve surface 453 adapted to seat against the valve seat 445. The valve member 451 also includes, in series, a stem portion 455 of reduced diameter as compared to the axial bore 443, an enlarged portion 457 guidingly engaging the axial bore 443, and a projecting end portion 459 of reduced diameter.

Means are provided for releasably biasing the valve surface 453 against the valve seat 445. While other constructions can be employed, in the disclosed construction, such means comprises a collar or retainer 461 which is suitably rigidly fixed to the projecting end portion 459 of the valve member 451 in spaced relation to the left end of the cylindrical portion 441 of the valve housing 431, and a helical spring 463 which, at one end, bears against the collar 461, which extends in surrounding relation to the cylindrical portion 441 of the valve housing 431, and which, at the other end, bears against the main portion 432 of the valve housing 431.

The valve or nozzle assembly 12 also includes a cup-shaped housing 471 which has a cylindrical portion 473 extending into the second counterbore 95 of the projecting portion 85 in radially spaced relation thereto and in surrounding relation to the helical spring 463 and which, at the right end thereof, is suitably rigidly fixed to the main portion 432 of the valve housing 431. The cup-shaped housing 471 also includes, at the left end thereof, an end portion 475 which includes an axial bore 477. Located within the cup-shaped housing 471, adjacent the end portion 475, is a suitable screen or filter 481 through which the high pressure fuel passes. The left or inner end of the axial bore 477 includes a counterbore 483 which serves as a seat for the check valve biasing spring 421.

Means are provided for mounting the combined fuel injection pump and nozzle assembly 9 on a fragmentarily illustrated engine block member which, at least in part, defines the combustion chamber 16 and which, in the disclosed construction, is in the form of a cylinder head 491. While other constructions can be employed, in the disclosed construction, the cylinder head 491 includes an aperture or bore 495 affording insertion thereunto of the nozzle assembly 12 in such manner as to locate the nozzle assembly 12 in communication with the combustion chamber 163. More particularly in this regard, the cylinder head 491 also includes, in radially outwardly spaced relation to the aperture 495, an outwardly extending annular or circular flange 497 including an internal threaded portion 499. Between the flange 497 and the combustion chamber 16, the cylinder head 491 includes an inclined transverse surface 501. Located in a cylindrical recess formed by the annular flange 497 are a pair of axially adjacent lock nuts or washers 511 and 513 which are engaged against the shoulder 90 formed on the outer surface 86 of the projecting portion 85 of the second housing member 63 and engaged by an outer end face or transverse surface 515 of a lock nut 521 which includes an inner annular surface 523 in telescopic engagement with the cylindrical portion 88 of the outer surface 86 of the projecting portion 85 of the second housing member 63 and an outer threaded surface or portion 525 which is threadedly engaged with the threaded portion 499 of the annular flange 497 to press the end surface 515 of the lock nut 521 against the washers 511 and 513 which, in turn, engage the shoulder 90 to press the second housing member 63 against the transverse surface 501 of the cylinder head 491.

The lock nut 521 also includes a hexagonal portion 527 which is adapted to be rotated by a suitable wrench to fix the combined fuel injection pump and nozzle assembly 9 to the cylinder head 491 with the nozzle assembly 12 in communication with the combustion chamber 16.

Means are provided for eliminating, or at least substantially reducing, noise generated consequent to closing of the one-way check valve 401. While other constructions can be employed, in the disclosed construction, the valve member 401 is fabricated of soft rubber, or other similar material impervious to fuel, and has a durometer value in the range of 60 to 100 and, preferably a value of 90, and which, consequent to closure of the one-way check valve 401, extends across the delivery end 131 of the tubular member 121, silently engaging the adjacent end of the tubular member 121 and/or the shoulder 133 to silently close off the delivery end 131 of the axial bore 127.

In operation, when the coil 391 is de-energized, the spring 211 displaces the armature and valve assembly 151 to the left in FIG. 1 from a pumping position (not shown). Such movement of the armature and valve assembly 151 to the left enlarges the volume of the high pressure fuel chamber 156 and causes movement of the valve member 201 to the right relative to the valve seat member 181. As a consequence, the valve surface 207 disengages the valve seat 189 and low pressure fuel is permitted to flow from the low pressure fuel chamber 79 through the radial bores 191 and 193, through the right end portion of the axial bore 187 in the valve seat member 181, and past the valve seat 189 into the high pressure fuel chamber 156.

Continued movement to the left of the armature and valve assembly 151 results in engagement of the left end of the valve member 201 in the blind bore or recess 227 in the stop member or adjusting piston 131 and in engagement of the left end of the valve seat member 181 with the stop member or adjusting piston 221, thereby locating the armature and valve assembly 151 in the full line position shown in FIG. 1 and thereby also locating the valve member 201 in the fully opened position relative to the valve seat member 181 so as to afford unrestricted communication between the low pressure fuel chamber 79 and the high pressure fuel chamber 156 as already explained.

When the coil 391 is energized, the armature and valve assembly 151 moves to the right against the action of the spring 351. Such movement of the armature and valve assembly 151 decreases the volume of the high pressure fuel chamber 156, causing movement of the valve member 201 to the left relative to the valve seat member 181, thereby sealingly engaging the valve surface 207 with the valve seat 189. Continued movement of the armature and valve assembly 151 to the right substantially instantaneously produces a relatively high fuel pressure in the high pressure fuel chamber 156 and delivery of high pressure fuel past the one-way check valve 401 and into the nozzle assembly 12.

Flow of high pressure fuel, when the one way check valve 401 is open, is past the valve element 411, through the space between the second counterbore 93 and the one way check valve 401, through the axial bore 483 in the cup-shaped housing 471, through the filter or screen 481, around the collar 461, through the apertures 442, through the axial bore 443 of the valve housing 431, between the valve member 451 and the valve housing 431, and past the valve seat 445 and the valve surface 453 (which separate in response to the high pressure in the fuel and against the action of the spring 463) and into the combustion chamber 16.

Upon completion of fuel delivery occurring consequent to de-energization of the coil 391, the pressure of the fuel in the high pressure chamber 156 falls and the one-way check valve 401 immediately closes to prevent return fuel flow into the high pressure fuel chamber 156 from the nozzle assembly 12. Such closure occurs relatively silently due to the use of soft rubber as one of the engaging members of the one-way check valve 401.

It is also noted that low pressure fuel is constantly circulated through the low pressure fuel chamber 79 and is continuously available for flow into the high pressure fuel chamber 156 incident to travel of the armature and valve assembly 151 to the left.

The disclosed construction is particularly economical and serves to reliably prevent leakage of low and high pressure fuel, to silently seat the one-way check valve 401, and to deliver high pressure fuel directly into the combustion chamber 16.

Various of the features of the invention are set forth in the following claims.

We claim:

1. An internal combustion engine comprising an engine block including a member defining a portion of a combustion chamber and having therein an opening communicating with said portion of said combustion chamber, and a combined fuel injection pump and nozzle including a housing fixed to said member of said engine block and defining a high reluctance gap and a low pressure fuel chamber having an axis, and a tubular member extending in said low pressure fuel chamber in said housing in coaxial relation to said axis, said tubular member having therein an axial bore communicating with said low pressure fuel chamber, and said tubular member at least partially defining a high pressure fuel chamber, and a nozzle assembly fixed to said housing, extending into said opening, communicating with said combustion chamber and with said axial bore, and including a valve member moveable to an open position in response to a fuel pressure in said high pressure fuel chamber above a predetermined level.

2. An internal combustion engine in accordance with claim 1 and further including a check valve located between said axial bore and said valve member and operable to permit fuel flow from said high pressure fuel chamber only in response to a pressure therein above a predetermined level.

3. An internal combustion engine in accordance with claim 1 wherein said engine block member comprises a cylinder head, wherein said housing includes an outer surface with a cylindrical portion and an annular shoulder, wherein said opening includes a counterbore remote from said combustion chamber and including an internally threaded portion, and a transverse surface located intermediate said combustion chamber and said counterbore, and further including an annular lock nut comprising an inner annular surface telescopically engaging said cylindrical portion of said outer surface of said housing, an outer surface with an externally threaded portion threadedly engaged with said internally threaded portion of said counterbore, and a transverse surface engaging said shoulder of said housing to press said housing into tight engagement with said transverse surface of said cylinder head.

4. A combined fuel injection pump and nozzle adapted to be mounted on an engine block and comprising a housing member defining a high reluctance gap and a low pressure fuel chamber having an axis, a tubular member extending from said housing member into said low pressure fuel chamber in coaxial relation to said axis, said tubular member having therein an axial bore communicating with said low pressure fuel chamber, and said tubular member at least partially defining a high pressure fuel chamber, and a nozzle assembly fixed to said housing member, communicating with said axial bore, and including a valve member moveable to an open position in response to a fuel pressure in said high pressure fuel chamber above a predetermined level.

5. A combined fuel injection pump and nozzle comprising a first housing member, a second housing member fixed to said first housing member and defining therebetween a high reluctance gap and a low pressure fuel chamber having an axis, a tubular member extending from one of said housing members into said low pressure fuel chamber in coaxial relation to said axis, said tubular member having therein an axial bore communicating with said low pressure fuel chamber, and said tubular member at least partially defining a high pressure fuel chamber, and a nozzle assembly fixed to said one housing member, adapted to be mounted on a cylinder head, communicating with said axial bore, and including a valve member moveable to an open position in response to a fuel pressure in said high pressure fuel chamber above a predetermined level.

6. A combined fuel injection pump and nozzle in accordance with claim 5 and further including a check valve located between said axial bore and said valve member and operable to permit fuel flow from said high pressure fuel chamber only in response to a pressure therein above a predetermined level.

7. A fuel injection pump and nozzle comprising a first housing member having an axis and including an end portion extending transversely to said axis, and a cylindrical bobbin supporting portion extending from end cap portion in concentric relation to said axis, and a second housing member fixed to said first housing member and including an end portion extending transversely to said axis, a cylindrical bobbin supporting portion extending from said end portion of said second housing member in concentric relation to said axis and in concentric alignment with and in spaced relation to said bobbin supporting portion of said first housing member to define therebetween a high reluctance gap, and a cylindrical housing portion extending from said end portion of said second housing member in co-axial relation to said axis and in the direction opposite to said second bobbin portion of said second housing member and defining a bore, a tubular member extending in co-axial relation to said axis, having therein an axial bore, and including an inner part rigidly fixed in said end portion of said second housing member, and a projecting part having an outer surface extending from said end portion of said second housing member in inwardly spaced relation to said bobbin supporting portion of said second housing member, and defining, with said bobbin supporting portions, a fuel chamber adapted to contain a fuel pumping assembly and communicating with said axial bore in said tubular member, and a valve assembly including a valve housing fixed in said bore of said cylindrical housing portion of said second housing member and including an axial bore communicating with said axial bore of said tubular member and having an end portion defining a valve seat, and a valve member moveable in said axial bore in said valve housing between a closed position engaged with said valve seat and an open position spaced from said valve seat.

8. A fuel injection pump and nozzle in accordance with claim 7 wherein said first end member includes a cylindrical housing portion extending from said end portion in concentric relation to said axis and in radially outwardly spaced relation to said bobbin portion, and wherein said second end member includes a second cylindrical housing portion fixed to said cylindrical housing portion of said first housing member and extending from said second end portion in concentric relation to said axis and in radially outward relation to said bobbin supporting portion of said second housing portion.

9. A fuel injection pump and nozzle in accordance with claim 8 wherein said housing portion of said first housing portion includes a threaded open end, and wherein said housing portion of said second housing member includes an outer end threadedly received in said threaded open end of said housing portion of said first housing member.

10. A fuel injection pump and nozzle in accordance with claim 9 and further including a bobbin located between said bobbin supporting portions and said housing members and sealingly engaged with said housing members and including an annular rib located in said gap.

11. A fuel injection pump and nozzle in accordance with claim 10 wherein said end portions and said bobbin supporting portions define an interior fuel pumping chamber, and wherein said second housing member includes a fuel inlet communicating with said pumping chamber, and a fuel outlet communicating with said pumping chamber.

12. A fuel injection pump and nozzle in accordance with claim 7 wherein said valve housing includes an inner end, wherein said valve member includes an inner end, and wherein said nozzle assembly also includes a retainer fixed to said inner end of said valve member, and a spring bearing against said inner end of said valve housing and against said retainer so as to bias said valve member into seating engagement with said valve seat when the fuel pressure in said valve assembly is below a predetermined pressure.

13. A fuel injection pump and nozzle in accordance with claim 12 wherein said nozzle assembly also includes a cup-shaped member including a wall extending transversely to said axis and including an axial bore, and a cylindrical portion extending from said transverse wall and fixed to said valve housing.

14. A fuel injection pump and nozzle in accordance with claim 13 and further including a fuel filter housed in said cylindrical portion of said cup-shaped member.

15. A fuel injection pump and nozzle in accordance with claim 14 wherein said first housing portion defines an outer axial counterbore housing said valve assembly, and an inner axial bore communicating with said outer counterbore and with said axial bore in said tubular member, wherein said inner part of said tubular member includes an end adjacent said inner axial bore of said first housing portion, and further including a check valve located in said inner axial bore of said first housing portion, and sealingly engaging said inner end of said inner part of said tubular member, and a spring bearing against said check valve and against said cup-shaped member.

16. A fuel injection pump and nozzle in accordance with claim 15 wherein said check valve includes a skirt extending toward said cup-shaped member, and wherein said spring is partially located within said skirt.

17. A fuel injection pump and nozzle in accordance with claim 16 wherein said end portions and said bobbin supporting portions define an interior fuel pumping chamber, and further including a piston located in said fuel pumping chamber adjacent said end portion of said first housing member and including a transverse surface, a seal engaging said piston and said bobbin supporting portion of said first housing member, and wherein said end portion of said first housing member includes a threaded axial bore, and further including an adjusting member threadedly engaged in said threaded bore and engaging said transverse wall of said piston to enable axial adjustment of the position of said piston in said fuel chamber.

18. A fuel injection pump and nozzle in accordance with claim 17 wherein said retainer includes an outer periphery, wherein said cylindrical portion of said cup-shaped member includes an inner surface having a diameter greater then said outer periphery of said retainer and defining an interior space, and wherein said valve housing includes a transverse bore communicating between said axial bore in said valve housing and said interior space.

19. A fuel injection pump and nozzle in accordance with claim 7 and further including a stroke adjustment member located adjacent said end portion of said first housing member and radially inwardly of said bobbin supporting portion thereof, and an adjustment element extending through said end portion of said first housing member, being adjustably axially displaceable relative to said end portion of said first housing member, and engaging said stroke adjustment member to adjustably displace said stroke adjustment member relative to said end portion of said first housing member.

20. A fuel injection pump and nozzle assembly comprising a fuel injection pump having an axis and comprising a first one-piece housing member including an end portion extending transversely to said axis, a cylindrical bobbin supporting portion extending from said end portion in concentric relation to said axis, and a cylindrical housing portion having a threaded open end and extending from said end portion in concentric relation to said axis, and in radially outwardly spaced relation from said bobbin supporting portion to partially define there between a bobbin compartment, a second one-piece housing member including an end portion extending transversely to said axis, a radially outer cylindrical housing portion extending from said end portion of said second housing member in concentric relation to said axis and having a threaded open end threadedly received in said threaded open end of said housing portion of said first housing member, and a cylindrical bobbin supporting portion extending from said end portion of said second housing member in concentric relation to said axis, and in concentric alignment with and in spaced relation to said bobbin supporting portion of said first housing member to define therebetween a high reluctance gap, and in radially inwardly spaced relation from said housing portion of said second housing member to partially define therebetween said bobbin compartment, a tubular member extending in co-axial relation to said axis, having therein an axial bore, and including an inner part rigidly fixed in said end portion of said second housing member, and a projecting part having an outer surface in inwardly spaced relation to said bobbin supporting portion of said second housing member, and extending into partially axially overlapping relation to said bobbin supporting portion of said first housing member, and defining with said bobbin supporting portions a low pressure fuel chamber, and one-way valve means located in said second housing member, communicating with said axial bore, and being selectively operable to permit flow from said axial bore for delivery to a fuel injecting nozzle and to prevent flow to said axial bore, an armature and valve assembly which has an outer surface radially separated from said bobbin supporting portions to further define therebetween said low pressure fuel chamber, which is axially movably supported on said outer surface of said projecting part of said tubular member, and which is operative in response to axial movement thereof relative to said tubular member to increase the pressure of the fuel in said axial bore in said tubular member to a relatively high pressure, and a bobbin contained in said bobbin compartment and including a cylindrical portion located adjacent said bobbin supporting portions and having opposite first and second ends, and a central flange extending from said cylindrical portion and including first and second transverse surfaces, a first o-ring sealingly engaged between said bobbin supporting portion of said first housing member and said first transverse surface of said bobbin, and a second o-ring sealingly engaged between said bobbin supporting surface of said second housing member and said second transverse surface of said bobbin.

21. A combined fuel injection pump and nozzle assembly comprising a first one-piece housing member fabricated of ferrous material, having an axis, and comprising an end portion extending transversely to said axis, a cylindrical bobbin supporting portion extending from said end portion in concentric relation to said axis, and a cylindrical housing portion extending from said end portion in concentric relation to said axis, and in radially outwardly spaced relation from said bobbin supporting portion to partially define therebetween a bobbin compartment, and having a threaded open end, a second one-piece housing member fabricated of ferrous material and including an end portion extending transversely to said axis, a cylindrical housing portion extending in concentric relation to said axis and having a threaded open end threadedly received in said open end of said housing portion of said first housing member, a cylindrical bobbin supporting portion extending from said end portion of said second housing member in concentric relation to said axis and in concentric alignment with and in spaced relation to said bobbin supporting portion of said first housing member to define therebetween a high reluctance gap, and in radially inwardly spaced relation from said housing portion of said second housing member to partially define therebetween said bobbin compartment, and a projecting portion extending from said end portion of said second housing member in the direction opposite from said bobbin supporting portion of said second housing member and having an axial bore concentric with said axis, a tubular member fabricated of ferrous material, extending in coaxial relation to said axis, having therein an axial bore, and including an inner part rigidly fixed in said end portion of said second housing member, and a projecting part having an outer surface in inwardly spaced relation to said bobbin portion of said second housing member, and extending from said end portion of said second housing member into partially axially overlapping relation to said bobbin supporting portion of said first housing member, and defining with said bobbin supporting portions a low pressure fuel chamber, a nozzle assembly fixed to said projecting portion and being adapted for direct communication with a combustion chamber, a one-way check valve located in said second housing member, communicating between said axial bore of said tubular member and said nozzle assembly, and being selectively operable to permit flow from said axial bore of said tubular member to said nozzle assembly and to prevent flow from said nozzle assembly to said axial bore of said tubular member, an armature and valve assembly which has an outer surface radially separated from said bobbin supporting portions and further defining therebetween said low pressure fuel chamber, which is axially movably supported on said projecting part of said tubular member, and which includes a bushing fabricated of non-ferrous material and including an outer surface, an end facing said end portion of said second housing member, and an interior bore in axially moveable sliding engagement on said outer surface of said projecting part of said tubular member, a sub-assembly fabricated of ferrous material, rigidly fixed on said outer surface of said bushing, and including an inner bore communicating with said axial bore of said tubular member to afford fuel flow therebetween and including a valve seat spaced from said end of said bushing, a valve member movable in and relative to said inner bore between spaced positions respectively preventing and permitting fuel flow through said inner bore and having a head located between said valve seat and said end of said bushing and including a valve surface in facing relation to said valve seat, and passage means affording fuel flow from said low pressure fuel chamber to said inner bore upstream of said valve seat, a bobbin fabricated of electrically insulating material, contained in said bobbin compartment and including a cylindrical portion located adjacent said bobbin supporting portions and having opposite first and second ends, and a central flange portion extending from said cylindrical portion into said gap and including first and second transverse surfaces, a first o-ring sealingly engaged between said bobbin supporting portion of said first housing member and said first transverse surface, and a second o-ring sealingly engaged between said bobbin supporting portion of said second housing member and said second transverse surface.

22. An internal combustion engine comprising an engine block including a member defining a portion of a combustion chamber and having therein an opening communicating with said portion of said combustion chamber, and a combined fuel injection pump and nozzle fixed to said member of said engine block and including a housing defining a high reluctance gap and a low pressure fuel chamber, and a tubular member extending in said low pressure fuel chamber in said housing and having therein an axial bore communicating with said low pressure fuel chamber, and a nozzle assembly fixed to said housing, extending into said opening, communicating between said combustion chamber and said axial bore, and including a valve member moveable to an open position in response to a fuel pressure above a predetermined level.

23. An internal combustion engine comprising an engine block including a member defining a portion of a combustion chamber and having therein an opening communicating with said portion of said combustion chamber, and a combined fuel injection pump and nozzle fixed to said member of said engine block and including a housing defining a high reluctance gap, a high pressure fuel chamber, and a low pressure fuel chamber, and a nozzle assembly fixed to said housing, extending into said opening, communicating between with said combustion chamber and said high pressure chamber, and including a valve member moveable to an open position in response to a fuel pressure above a predetermined level.

24. A combined fuel injection pump and nozzle adapted to be mounted on an engine block member having therein an opening communicating with a combustion chamber, said combined fuel injection pump and nozzle including a pump assembly defining a high reluctance gap, a high pressure fuel chamber, and a low pressure fuel chamber, and a nozzle assembly fixed to said pump assembly, communicating with said high pressure chamber, being adapted to extend into the opening and to communicate with the combustion chamber, and including a valve member moveable to an open position in response to a fuel pressure above a predetermined level.

25. A combined fuel injection pump and nozzle comprising a pump assembly having an axis, defining a high reluctance gap, a high pressure fuel chamber, and a low pressure fuel chamber in axial alignment with said low pressure fuel chamber, said combined fuel injection pump and nozzle including a first housing member, a second housing member fixed to said first housing member, and a tubular member extending in axial alignment with said high and low pressure fuel chambers and having therein an axial bore communicating with said low pressure fuel chamber, and a nozzle assembly fixed to said pump assembly, communicating with said high pressure fuel chamber, being adapted to communicate with a combustion chamber, and including a valve member moveable to an open position to supply fuel to the combustion chamber in response to a fuel pressure in said high pressure fuel chamber above a predetermined level.

* * * * *